US007481391B2

(12) United States Patent
Kuo

(10) Patent No.: US 7,481,391 B2
(45) Date of Patent: Jan. 27, 2009

(54) AIR SHAFT

(76) Inventor: Ming-Hsiang Kuo, No. 9, Alley 22, Lane 22, Shezih St., Shihlin District, Taipei (TW)

( * ) Notice: Subject to any disclaimer, the term of this patent is extended or adjusted under 35 U.S.C. 154(b) by 173 days.

(21) Appl. No.: 11/505,808

(22) Filed: Aug. 18, 2006

(65) Prior Publication Data

US 2008/0042005 A1 Feb. 21, 2008

(51) Int. Cl.
*B65H 75/24* (2006.01)

(52) U.S. Cl. ..... 242/571.1; 492/4

(58) Field of Classification Search ..... 242/571, 242/571.1; 492/4, 5

See application file for complete search history.

(56) References Cited

U.S. PATENT DOCUMENTS 3,206,135 A * 9/1965 Uncapher ..... 242/573.2
3,391,878 A * 7/1968 Naccara ..... 242/571.1
4,229,014 A * 10/1980 Crowe ..... 279/2.07
4,461,430 A * 7/1984 Lever ..... 242/530.3
5,904,315 A * 5/1999 McInerney ..... 242/571
6,065,715 A * 5/2000 Andersson ..... 242/571.1

* cited by examiner

*Primary Examiner*—Peter M Cuomo
*Assistant Examiner*—Sang Kim
(74) *Attorney, Agent, or Firm*—Bacon & Thomas, PLLC

(57) ABSTRACT

The present invention is to provide an air shaft comprising a hollow cylinder and a plurality of curved members provided on an outer surface of the hollow cylinder and between both ends thereof, wherein the curved members are adapted to move radially relative to the hollow cylinder and are spaced each other with a gap formed between any two adjacent ones of the curved members. As such, no continuous straight gaps are formed on an outer surface of the hollow cylinder while pushing the curved members. By utilizing the present invention, a web material can be wound on the air shaft directly without the need of mounting a roll on an outer surface of the air shaft, thereby eliminating the drawbacks of the prior art air shaft.

3 Claims, 7 Drawing Sheets

AIR SHAFT

FIELD OF THE INVENTION

The present invention relates to air shafts, and more particularly to an air shaft capable of not pinching the cores of rolls of paper, plastic film or any of other web materials neither in a process of winding same thereon nor in a process of unwinding same therefrom.

BACKGROUND OF THE INVENTION

Conventionally, paper, plastic film, metal plate, cloth, or any of other web materials is supplied in large rolls wound on cylindrical cores. When the rolls are being wound or unwound, the cores are usually mounted on rotatable shafts. Inflated air shafts are typically used to lock the core to the rotatable shaft so that the rolls may rotate with the rotatable shaft as a unit.

Typically, an air shaft may be implemented as a button model, a serrated key model, a lug or strip model, or a plate model based on its appearance. Each of the above types of air shaft is adapted to insert into the cores of rolls of a specific material. However, these types of air shaft have some disadvantages. Thus, a manufacturer of the art devises a plate model air shaft as disclosed in Taiwanese Utility Model Patent No. 475,593 ("593" Patent). The "593" Patent is proposed as an improvement of the typical button model air shaft which has gripping members on its outer surface adapted to urge against an inner surface of the cores of rolls of material when the air shaft is inflated. However, there is an imbalance of force between portions of the cores of rolls of material being urged and portions of the cores of rolls of material being not urged. As a result, the cores of rolls of material tend to permanently deform or even twist. This is not desirable.

The "593" Patent as an improvement of the typical button model air shaft is a plate model air shaft as shown in FIGS. 1 and 2. The air shaft comprises a hollow cylinder 11, a plurality of curved inner plates 12 arranged as a hollow cylindrical member inside the hollow cylinder 11 and spaced therewith, a plurality of curved outer plates 13 arranged as a hollow cylindrical member on an outer surface of the hollow cylinder 11, an airtight bladder 14 in the shape of a hollow cylinder provided on an inner surface of the inner plates 12, a plurality of radial cylindrical sliding members 15 interconnecting the inner and the outer plates 12 and 13 through the hollow cylinder 11, and a resilient member (not shown) provided between the inner plates 12 and the hollow cylinder 11. The inflated bladder 14 expands to push the inner plates 12 outwardly toward the outer plates 13 which in turn tightly engage with (i.e., lock) an inner surface of the core of a roll 16. As such, the roll 16 rotates with the plate model air shaft as a unit in a material winding or unwinding operation. As stated above, the outer plates 13 are curved and are formed of an elastomeric material. Thus, the outer plates 13 may elastically deformed in response to inward pressure exerted thereon by the roll 16. As such, the outer plates 13 are completely engaged with the inner surface of the roll 16. As an end, the roll 16 is fully supported and its circumference can be maintained.

However, the above types of air shaft have disadvantages. In detail, material is wound on the roll 16 in use. The roll 16 is discarded after unwinding the material from the roll 16. This is a waste in view of environmental protection. Also, manufacturers of the roll 16 do not have the desire to recycle rolls 16 since it can incur a great cost. Further, the plate model air shaft cannot directly wind a web material thereon due to the following reasons.

Firstly, the plate model air shaft can maintain its circumference in use. However, there is a gap "s" between any two adjacent outer plates 13 of the plate model air shaft. Thus, portions of a web material may be pinched by the gaps "s" when it is wound on an outer surface of the outer plates 13.

Secondly, the gaps "s" may decrease after deflating the bladder 14. As such, portions of a web material may be pinched by the gaps "s". As a result, it is impossible of unwinding the material from the plate model air shaft.

Thus, it is desirable to provide a novel air shaft capable of not pinching the cores of rolls 16 of a web material neither in a process of winding same thereon nor in a process of unwinding same therefrom, being environmental friendliness, and without requiring a manufacturer of the roll 16 to recycle same after use.

SUMMARY OF THE INVENTION

After considerable research and experimentation, an air shaft according to the present invention has been devised so as to overcome the above drawbacks of the prior art.

It is an object of the present invention to provide an air shaft comprising a hollow cylinder, and a plurality of curved members provided on an outer surface of the hollow cylinder and between both ends thereof. The curved members are adapted to move radially relative to the hollow cylinder. The curved members are spaced each other with a gap formed between any two adjacent ones of the curved members. As such, no continuous straight gaps are formed on an outer surface of the hollow cylinder while pushing the curved members. By utilizing the present invention, a web material can be wound on the air shaft directly without the need of mounting a roll on an outer surface of the air shaft, thereby eliminating the drawbacks of the prior art air shaft.

The above and other objects, features and advantages of the present invention will become apparent from the following detailed description taken with the accompanying drawings.

DETAILED DESCRIPTION OF THE PREFERRED EMBODIMENTS

Figure 1:
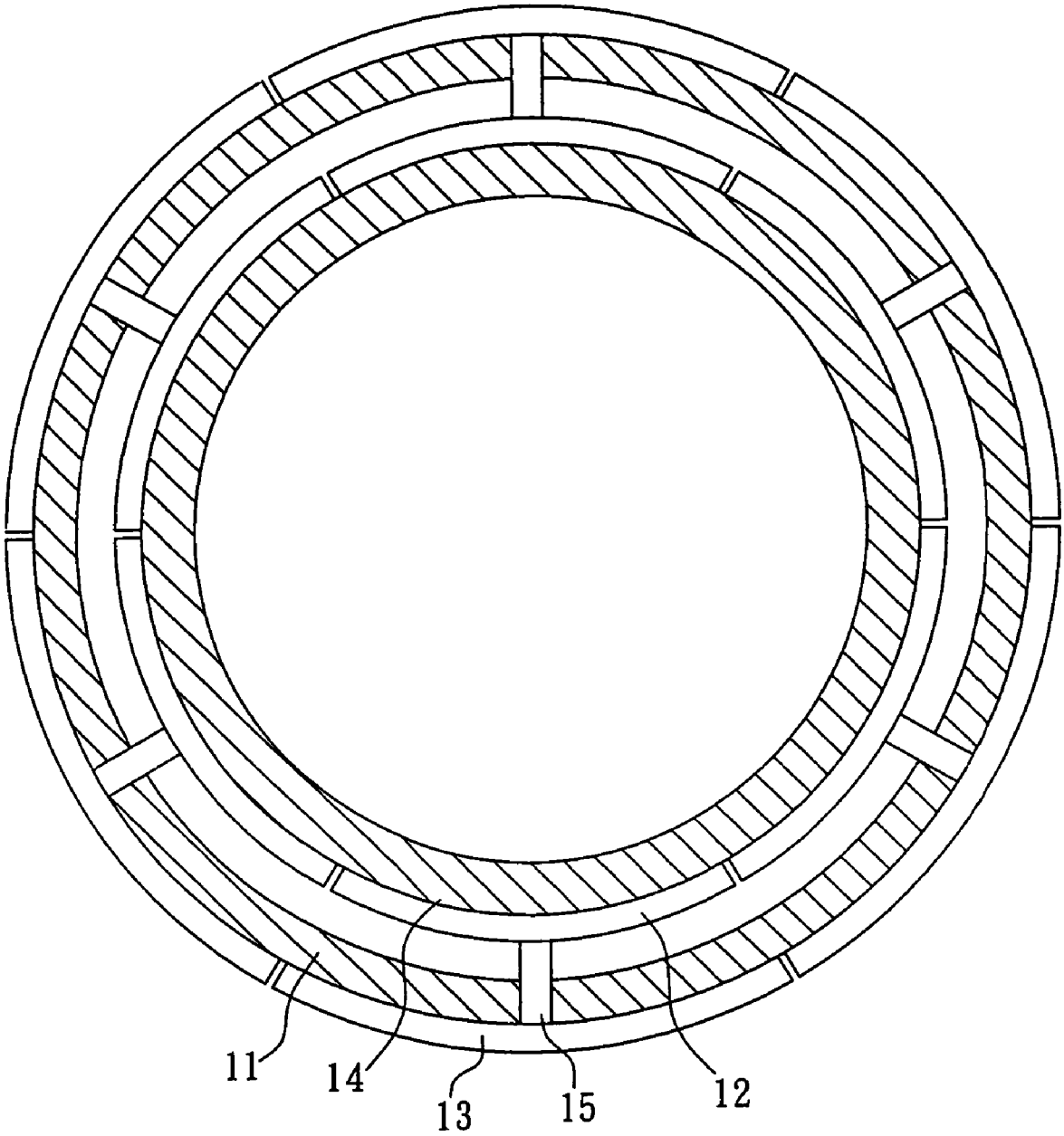
FIG. 1(Prior Art)
FIG. 1 is a cross-sectional view of a conventional air shaft prior to inflation.
Figure 2:
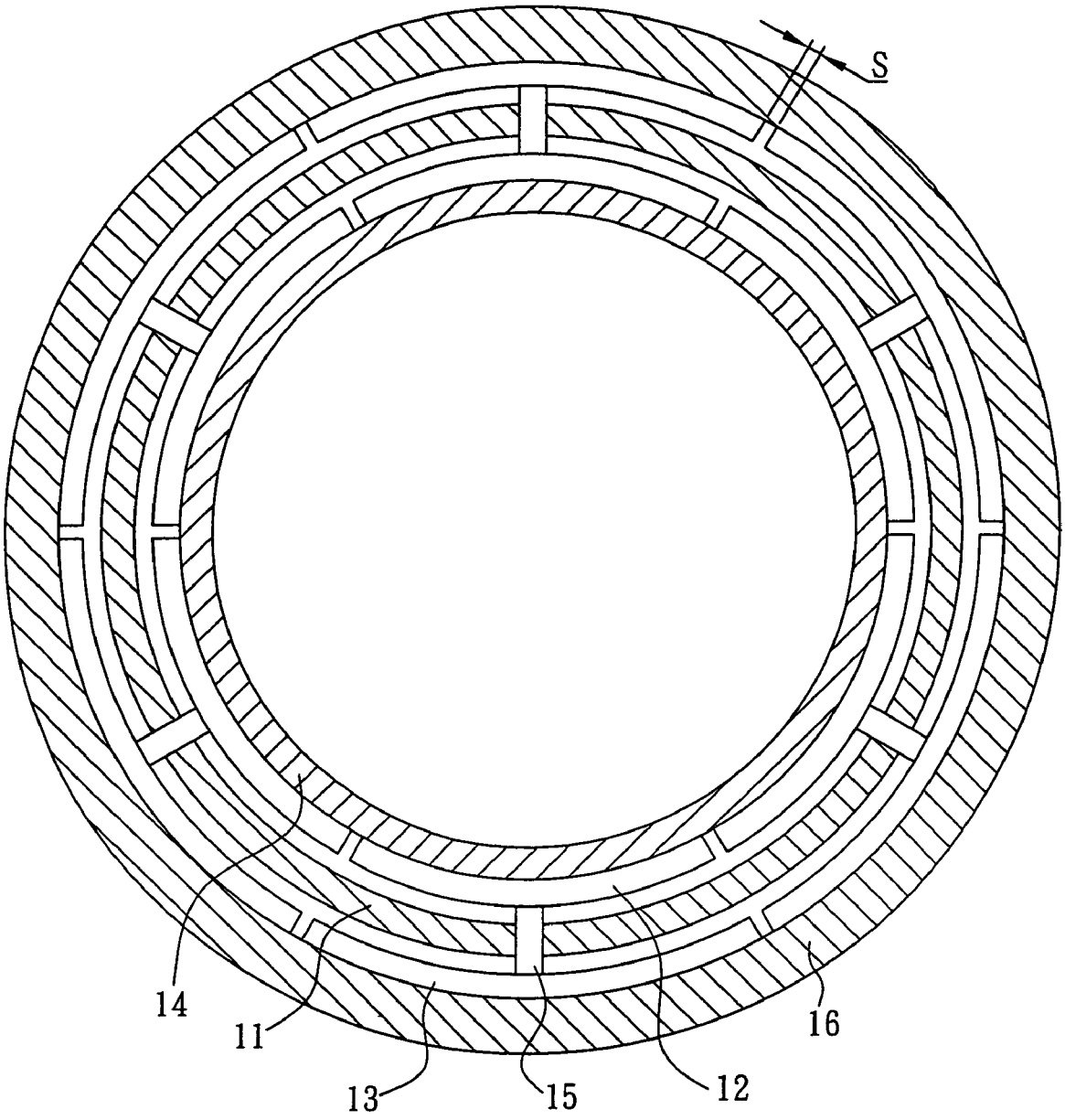
FIG. 2(Prior Art)
FIG. 2 is a view similar to FIG. 1 where the air shaft has been inflated.
Figure 3:
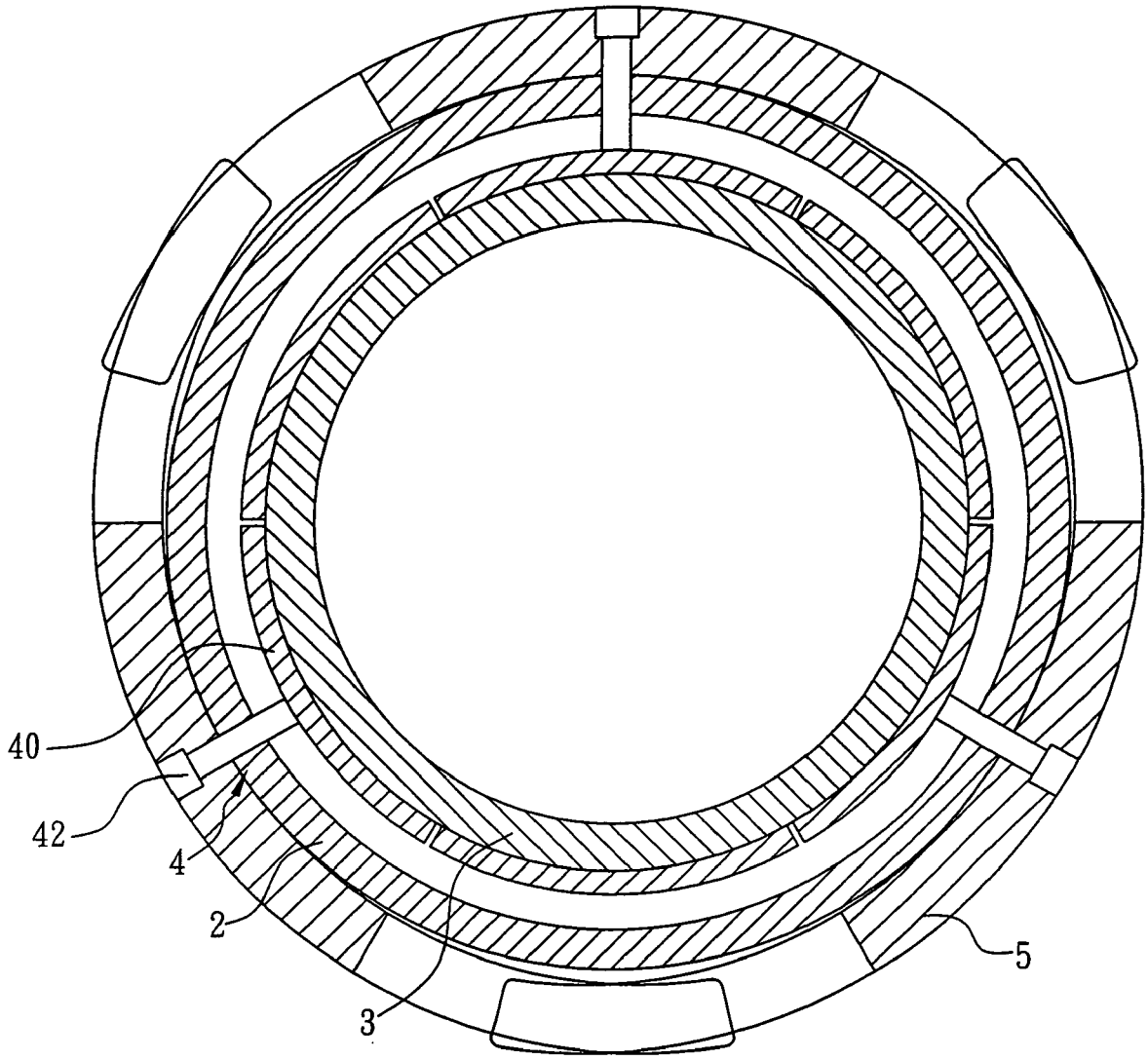
FIG. 3 is a cross-sectional view of an air shaft according to the invention prior to inflation.
Figure 4:
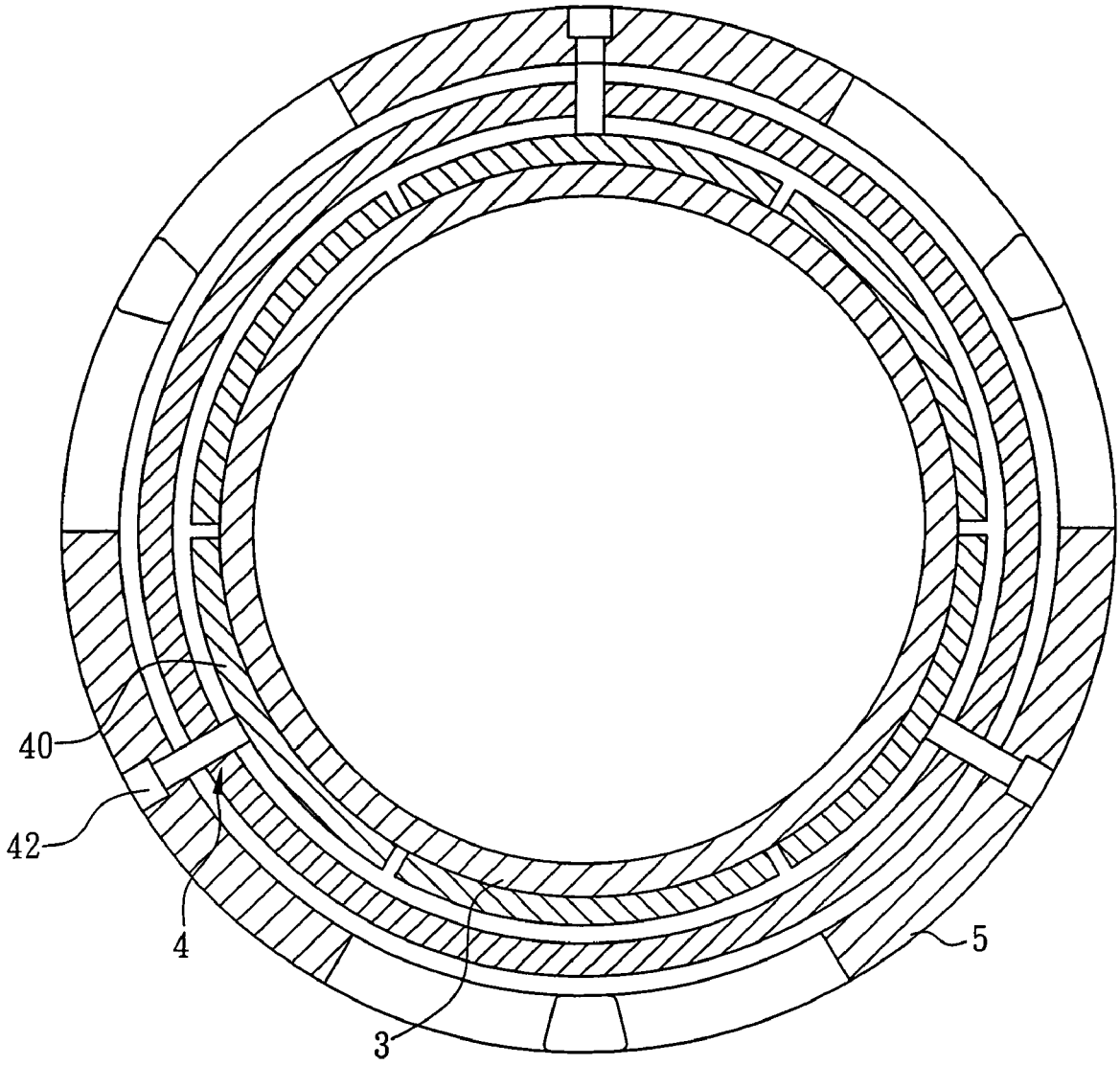
FIG. 4 is a view similar to FIG. 3 where the air shaft has been inflated.

Referring to FIGS. 3 and 4, an air shaft in accordance with the invention comprises a hollow cylinder 2, an inflatable airtight bladder 3 in the hollow cylinder 2, a plurality of movable members 4 provided externally of the bladder 3, each movable member 4 having a portion radially passed through the hollow cylinder 2, and a plurality of curved members 5 provided on an outer surface of the hollow cylinder 2 and between both ends thereof. The portion of the movable member 4 radially passed through the hollow cylinder 2 is secured to an outer surface of the curved member 5.

Figure 5:
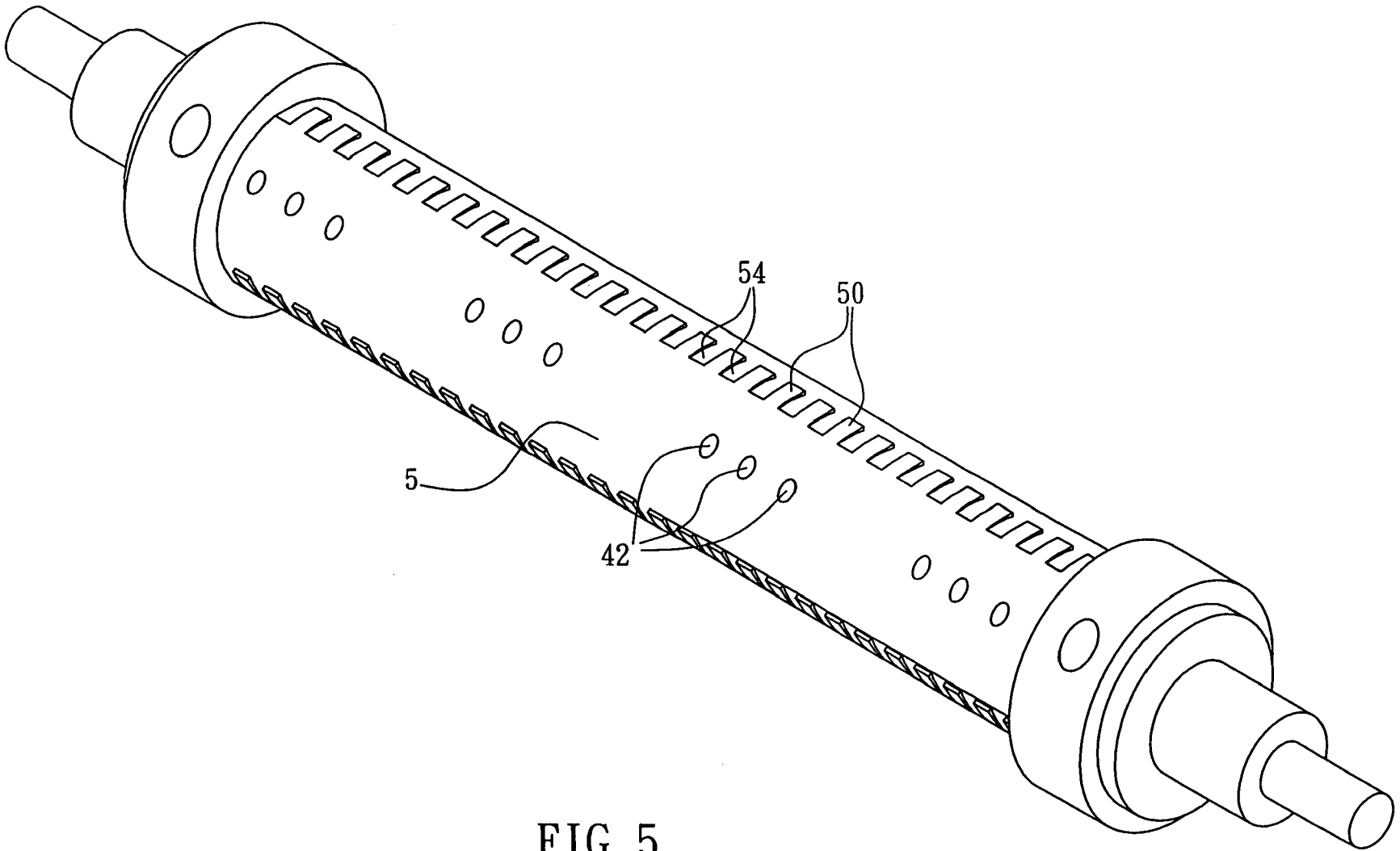
FIG. 5 is a perspective view of the air shaft of FIG. 3 prior to inflation.
Figure 6:
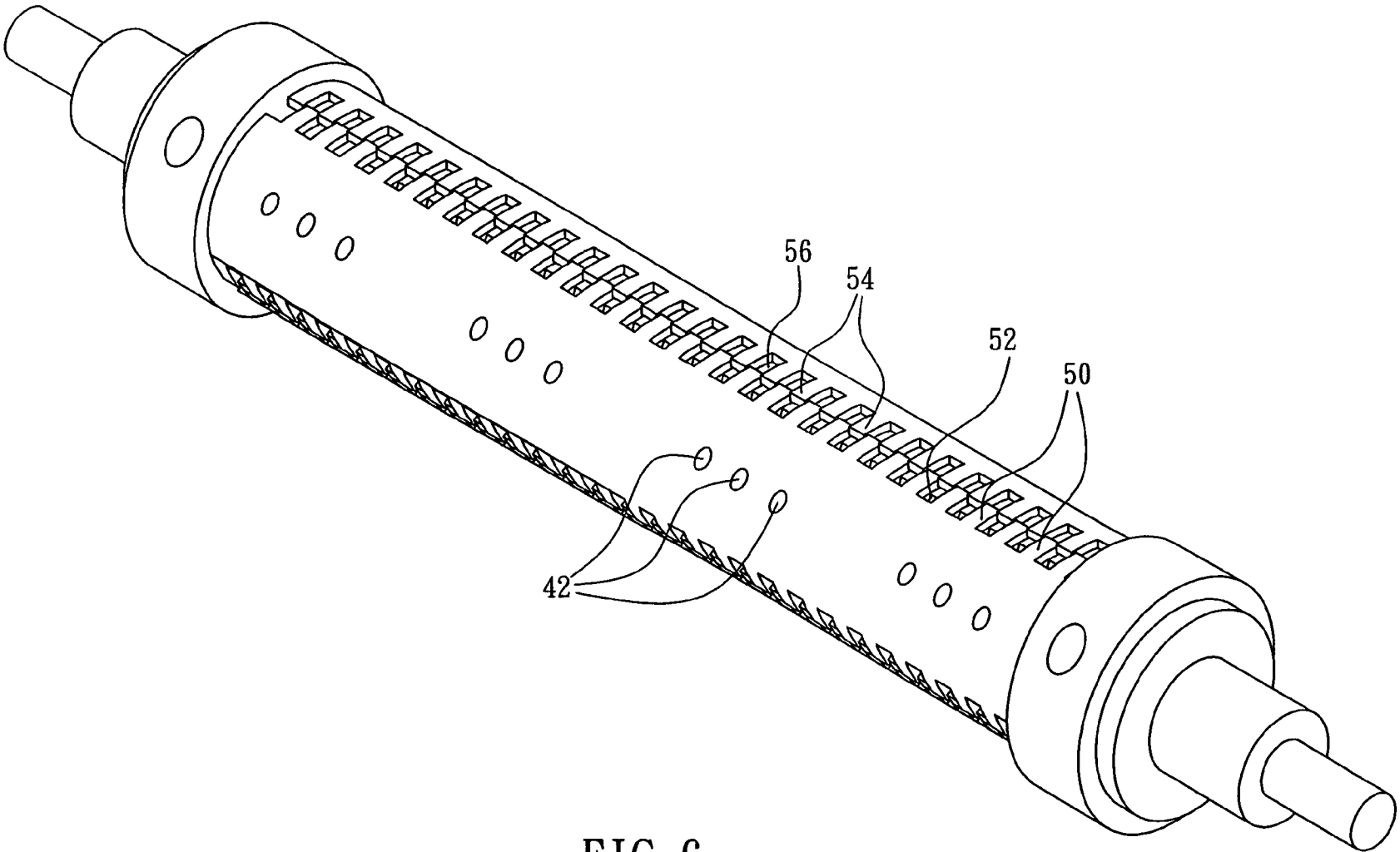
FIG. 6 is a view similar to FIG. 5 where the air shaft has been inflated.

Referring to FIGS. 5 and 6 in conjunction with FIGS. 3 and 4, a plurality of spaced first projections 50 are formed on one side of the curved members 5. The first projections 50 are disposed axially and overlay the hollow cylinder 2. The curved member 5 further comprises a first slot 52 between any two adjacent first projections 50. A plurality of second slots 56 are formed on the other sides of the curved members 5 lining up with the first projections 50. The second slots 56 are disposed axially and overlay the hollow cylinder 2. A plurality of spaced second projections 54 are formed on the other sides of the curved members 5 lining up with the first slots 52. The second projections 54 are disposed axially and overlay the hollow cylinder 2. Thus, the first projections 50 are adapted to snugly fit into the second slots 56. Also, the second projections 54 are adapted to snugly fit into the first slots 52. That is, the curved members 5 are spaced with a gap formed between two adjacent curved members 5. Prior to inflating the bladder 3, for the curved members 5 tops of the first and second projections 50 and 54 are about flush with tops of the first and second slots 52 and 56 (see FIG. 5). The curved members 5 are pushed outwardly by the movable members 4 after inflating the bladder 3. As an end, tops of the first and second projections 50 and 54 are about flush with tops of the first and second slots 52 and 56.

In view of the above, it is clear that no continuous gaps are formed on an outer surface of the air shaft. Thus, a web material is adapted to wind on the air shaft after inflating the bladder 3. Also, portions of the material will not be pinched by gaps as contrary to that experienced by the prior art outer plates 13. Further, the material will not be pinched by the curved members 5 while deflating the bladder 3 of the air shaft. This eliminates the need of mounting a roll on the outer surface of the air shaft prior to winding the material. As a result, the prior art drawbacks are eliminated. In one embodiment of the invention, each of the movable members 4 comprises a curved inner plate 40 and a sliding member 42 extending outwardly radially from the inner plate 40. The inner plates 40 are provided between two ends of the bladder 3. Each of the inner plates 40 is spaced from a corresponding curved member 5 and lines up therewith radially. One end of the sliding member 42 is formed with the inner plate 40 facing an inner surface of the hollow cylinder 2 and the other end thereof extends through the hollow cylinder 2 to secure to the corresponding curved member 5. A circumferential gap is formed between the inner plates 40 and the hollow cylinder 2 and the curved members 5 overlay the outer surface of the hollow cylinder 2 prior to inflating the bladder 3. In comparison, the inner plates 40 are pushed radially toward a position proximate the inner surface of the hollow cylinder 2 with a circumferential gap formed between the hollow cylinder 2 and the curved members 5 in response to inflating the bladder 3.

In another embodiment of the invention, each of the movable members 4 comprises a curved inner plate 40 and a sliding member 42 extending outwardly radially from the inner plate 40. The inner plates 40 are provided airtight in the bladder 3 and between two ends thereof. Each of the inner plates 40 is spaced from a corresponding curved member 5 and lines up therewith radially. One end of the sliding member 42 is formed airtight in the inner plate 40 facing an inner surface of the bladder 3 and the other end thereof extends through the bladder 3 and the hollow cylinder 2 to secure to the corresponding curved member 5. A circumferential gap is formed between the inner plates 40 and an inner surface of the hollow cylinder 2 and the curved members 5 overlay the outer surface of the hollow cylinder 2 prior to inflating the bladder 3. In comparison, the inner plates 40 are pushed radially toward a position proximate the inner surface of the hollow cylinder 2 with a circumferential gap formed between the hollow cylinder 2 and the curved members 5 in response to inflating the bladder 3.

Figure 7:
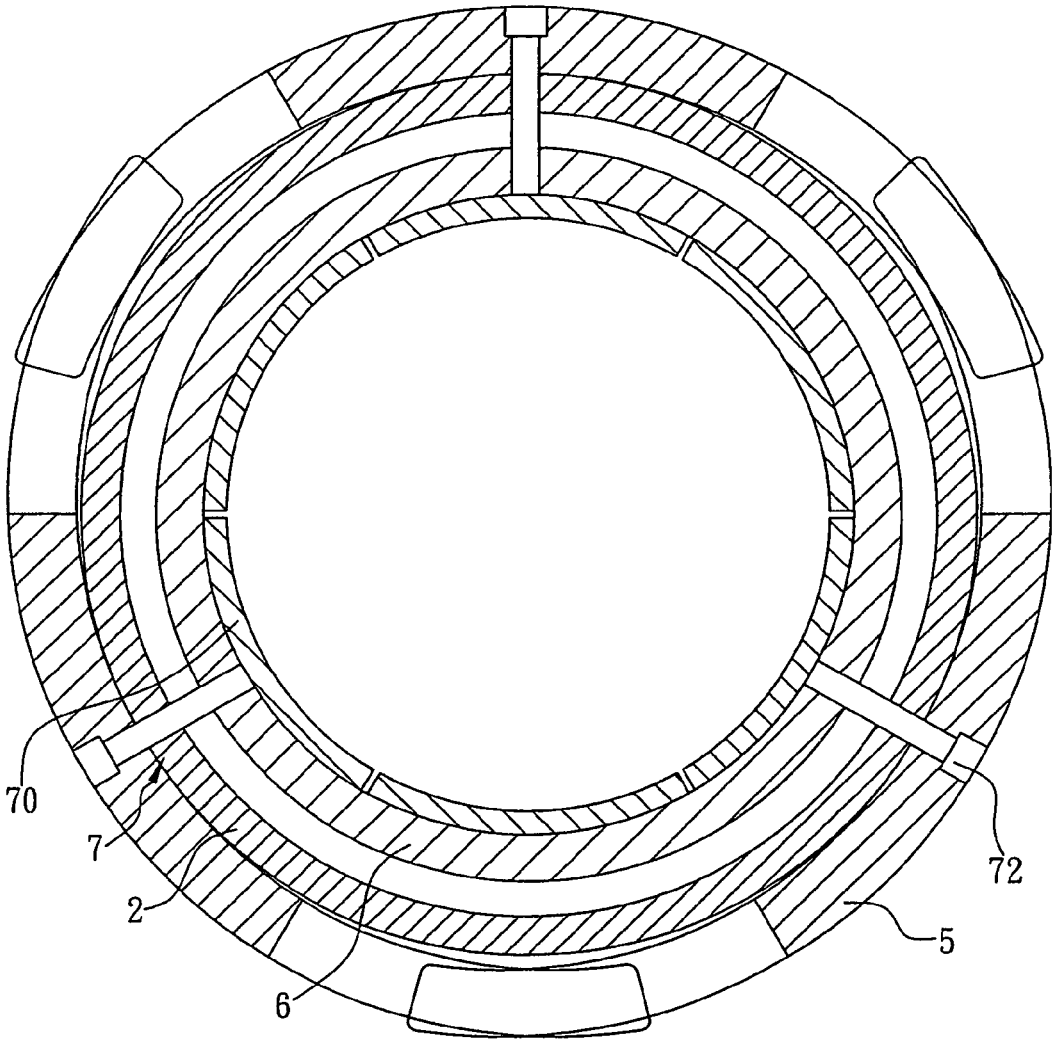
FIG. 7 is on cross-sectional view of an air shaft according to another embodiment of the invention prior to inflation.

Referring to FIG. 7. in another embodiment of the invention, each of the movable members 7 comprise a curved inner plate 70 and a sliding member 72 extending outwardly and radially from the inner plate 70. The inner plates 70 are provided between two ends of the bladder 6. Each of the inner plates 70 is spaced from a corresponding curved member 5 and lines up therewith radially. One end of the sliding member 72 is formed airtight in the inner plate 70 facing an inner surface of the bladder 6 and the other end thereof extends through the bladder 6 and the hollow cylinder 2 to secure to the corresponding curved member 5. A circumferential gap is formed between the bladder 6 and an inner surface of the hollow cylinder 2 prior to inflating the bladder 6. In comparison, the inner plates 70 are pushed radially toward a position proximate the inner surface of the hollow cylinder 2 with a circumferential gap formed between the hollow cylinder 2 and the curved members 5 in response to inflating the bladder 6.

In view of the above, the first projections 50 are adapted to snugly fit into the second slots 56. Also, the second projections 54 are adapted to snugly fit into the first slots 52. That is, no continuous straight gaps are formed by the curved members 5 prior to pushing the curved members 5. Thus, portions of the material will not be pinched by gaps in the winding process of the material. Also, the material will not be pinched by the curved members 5 while deflating the bladder 3 in the unwinding process of the material. As a result, the prior art drawbacks are eliminated.

While the invention herein disclosed has been described by means of specific embodiments, numerous modifications and variations could be made thereto by those skilled in the art without departing from the scope and spirit of the invention set forth in the claims.

What is claimed is:

1. An air shaft comprising:

a hollow cylinder;

an inflatable airtight bladder in the hollow cylinder;

a plurality of movable members provided externally of the bladder, each of the movable members having a portion radially passed through the hollow cylinder; and a plurality of curved members provided on an outer surface of the hollow cylinder and between both ends thereof, the portion of the movable member radially passed through the hollow cylinder being secured to an outer surface of the curved member; wherein each of the curved members comprises a plurality of first projections formed on one side, the first projections being disposed axially and overlaying the hollow cylinder, a plurality of first slots each disposed between adjacent first projections, a plurality of second slots formed on the other side and lined up with the first projections, the second slots being disposed axially and overlaying the hollow cylinder, and a plurality of second projections formed on the other side and lined up with the first slots, the second projections being disposed axially and overlaying the hollow cylinder;

the first projections are adapted to fit into the second slots, and the second projections are adapted to fit into the first slots; and prior to inflating the bladder, tops of the first and second projections are substantially flush with tops of the first and second slots, and the curved members are pushed outwardly by the movable members after inflating the bladder such that the tops of the first and second projections are substantially flush with the tops of the first and second slots.

2. The air shaft of claim 1, wherein each of the movable members comprises:

a curved inner plate provided between ends of the bladder, the inner plates being spaced from a corresponding one of the curved members and lined up therewith radially, a circumferential gap being formed between the inner plates and the hollow cylinder prior to inflating the bladder, and the inner plates being pushed radially toward a position proximate an inner surface of the hollow cylinder in response to inflating the bladder; and a sliding member extended outwardly radially from the inner plate and having one end formed with the inner plate facing the inner surface of the hollow cylinder and the other end extended through the hollow cylinder and secured to the corresponding curved member, the inner plates being pushed radially toward the position proximate the inner surface of the hollow cylinder in response to inflating the bladder, and the curved members being brought inwardly toward the hollow cylinder by the sliding members in response to deflating the bladder.

3. The air shaft of claim 1, wherein each of the movable members comprises:

a curved inner plate provided airtight in the bladder and between ends thereof, the inner plates being spaced from a corresponding one of the curved members and lined up therewith radially, a circumferential gap being formed between the inner plates and an inner surface of the hollow cylinder prior to inflating the bladder, and the inner plates being pushed radially toward a position proximate the inner surface of the hollow cylinder in response to inflating the bladder; and a sliding member extended outwardly radially from the inner plate and having one end formed airtight in the inner plate facing an inner surface of the bladder and the other end extended through the bladder and the hollow cylinder and secured to the corresponding curved member.

* * * * *